US005181605A

United States Patent [19]

Bishop et al.

[11] Patent Number: 5,181,605

[45] Date of Patent: * Jan. 26, 1993

[54] KEY COVER

[75] Inventors: Thomas R. Bishop, Spring Lake; Richard A. Thom, Muskegon; Frank L. Breveglieri, Spring Lake, all of Mich.

[73] Assignee: Pliant Plastics Corporation, Muskegon, Mich.

[ * ] Notice: The portion of the term of this patent subsequent to Jan. 28, 2009 has been disclaimed.

[21] Appl. No.: 782,419

[22] Filed: Oct. 25, 1991

Related U.S. Application Data

[63] Continuation-in-part of Ser. No. 667,809, Mar. 12, 1991, Pat. No. 5,083,662.

[51] Int. Cl.[5] ..... E05B 19/04

[52] U.S. Cl. ..... 206/37.1; 70/456 R; 70/408; 206/37.3

[58] Field of Search ..... 70/395, 408, 460, 458, 70/457, 456 R; 206/37.1, 37.3

[56] References Cited

U.S. PATENT DOCUMENTS

| | | | |
|---|---|---|---|
| 2,816,434 | 12/1957 | Olson | 70/458 X |
| 3,349,589 | 10/1967 | Fricke | 70/395 |
| 3,841,120 | 10/1974 | Gartner | 70/395 |
| 3,908,418 | 9/1975 | Stoffel | 70/458 X |
| 4,102,166 | 7/1978 | Hughes | 70/456 R |
| 4,305,267 | 12/1981 | Nish et al. | 70/395 |
| 4,403,487 | 9/1983 | Marty | 70/408 |
| 4,472,954 | 9/1984 | Kichise | 70/408 |
| 4,768,362 | 9/1988 | Schmalz, Jr. | 70/408 |
| 5,0391590 | 8/1991 | Sawyer et al. | 70/458 |
| 5,083,662 | 1/1992 | Bishop et al. | 206/37.1 |

FOREIGN PATENT DOCUMENTS

| | | | |
|---|---|---|---|
| 2712759 | 9/1978 | Fed. Rep. of Germany | 70/408 |
| 2218463 | 11/1989 | United Kingdom | 70/456 R |

*Primary Examiner*—William I. Price

*Attorney, Agent, or Firm*—Varnum, Riddering, Schmidt & Howlett

[57] ABSTRACT

This relates to a key cover for covering the head of a key. In one embodiment, the key cover is formed in two pieces, a cover member and a plug. In a second embodiment, the cover member and plug are pivotally connected. The cover member is provided with a cavity for receiving the key head with the blade of the key passing through a slot in the underside of the cover member. A plug is then readily insertable into the top of a cavity in overlying relation to the key head disposed within the cavity of the cover member and locked in place with the cover member. The interlock between the plug and the cover member is one wherein the plug cannot be readily removed unless the cover, for all practical purposes, is locked in place on the key. This permits the key cover to be individually applied to a key without materially disassociating the key from its respective lock.

18 Claims, 2 Drawing Sheets

KEY COVER

BACKGROUND OF THE INVENTION

This application is a continuation-in-part of U.S. application Ser. No. 07/667,809, filed on Mar. 12, 1991, now U.S. Pat. No. 5,083,662.

1. Field of the Invention

This invention relates in general to new an improvements in covers for keys, and more particularly to a key cover which includes a cover member for receiving therethrough a key with the head of a key being retained and latched within the cover member.

2. Scope of the Prior Art

It is known to provide covers for keys. Key covers in the past come basically in two forms: (1) integrally molded around the key; and (2) multipart covers which are fabricated around the key. The molded covers are formed by placing a key head in a mold and injecting a polymer into the mold to encapsulate the key head. After the polymer is cured, the key with the integrally molded cover is removed. One of the principal disadvantages afforded by this process is: that a tracking system must be maintained to ensure that each key can be relocated with its corresponding lock. Otherwise, the locks have to be rekeyed after the keys are covered. In addition, alignment of keys in the mold is critical, and such alignment is typically done manually. Further, most keys are stamped and there are some inherent difficulties in molding polymers around stamped metal parts. Overall, the process is quite expensive and adds significantly to the cost of the key and lock system. The fabricated covers typically comprise two premolded halves, each half having a recessed area to receive the key head. When the key head is placed in the recessed area, the two halves are attached to envelop the key head and provide a cover. The two halves are typically attached by gluing. Again, the key cover is not installable in the field, and thus requires that the key be separated from its corresponding lock. Further, gluing parts together has inherent disadvantages requiring additional materials, time and labor to fabricate the cover. In addition, such covers have a tendency to come apart in the field with use.

SUMMARY OF THE INVENTION

The invention particularly relates to a premolded key cover member with a cavity to receive the key head. A slot extending from the cavity through one end of the cover member is adapted to receive the blade and the key. The other end of the cover member has a wider slot so that the key is received within the cover member blade first, and the head of the key rests within the cavity with the blade extending through the slot external of the cover member.

In one aspect of the invention, a separate insert in the form of a plug is then received within the wide slot to plug the open end of the cover member and bear against the edge of the key head to hold the key head securely within the cavity. A tab on at least one side of the plug snaps into a premolded detent in the cover member to securely retain the plug in the end of the cover member. The plug is flush with the cover member so that it effectively cannot be removed without deforming the cover member or the insert.

In another aspect of the invention, the cover member and plug insert are molded as a single piece, including a hinge which connects the plug to the cover member.

The hinge connects the upper corner of the plug to the upper corner of the cover member, allowing rotation of the plug about the hinge and into the top opening of the cover member. A boss on at least one side of the plug snaps into a premolded hole in the cover member to securely retain the plug in the end of the cover member.

With the above and other objects in view that will hereinafter appear, the nature of the invention will be more clearly understood by reference to the following detailed description, the appended claims, and the several views illustrated in the accompanying drawing.

DETAILED DESCRIPTION OF THE DRAWINGS

Figure 7:
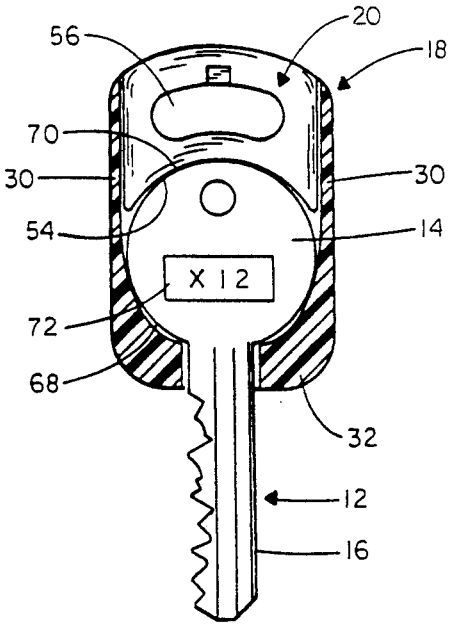
FIG. 7 is a vertical sectional view taken through the entire key cover with a typical key inserted within the cover member and retained in place by the plug, the view being similar to FIG. 4.

Referring now to the drawings in detail, with reference to FIG. 7, it will be seen that for the first embodiment there is illustrated a key cover 10 which is constructed to receive on site a key, generally identified by the numeral 12 which includes a head 14, sometimes also known as a "bow", and a blade 16.

The key cover 10 is formed in two parts, a cover member generally identified by the numeral 18 and an insert or plug generally identified by the numeral 20.

Figure 1:
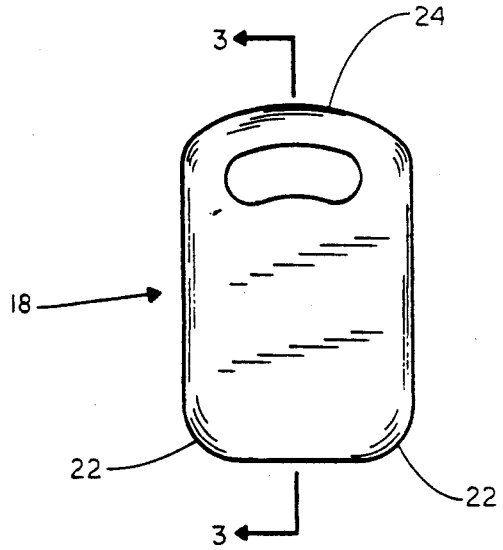
FIG. 1 is a side elevational view of a cover member formed in accordance with this invention.

The cover member 18, which is best illustrated in FIGS. 1 through 4, is of a generally rectangular outline and, as best shown in FIG. 1, is provided with lower corners 22 and a curved top wall 24. Although the preferred embodiment is illustrated, it will be understood that the cover member 18 can take any shape commensurate with the dimensions of the key head 14 and aesthetic requirements.

Figure 3:
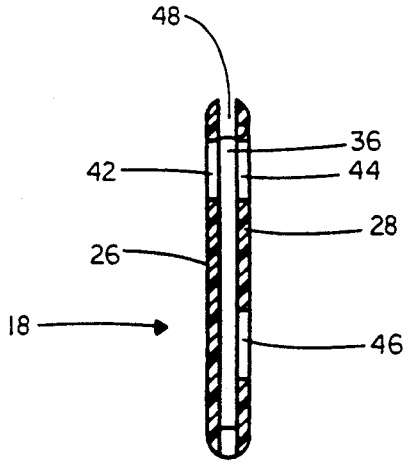
FIG. 3 is a vertical sectional view through the cover member taken generally along the line 3—3 of FIG. 1 and shows the general cross section thereof.
Figure 4:
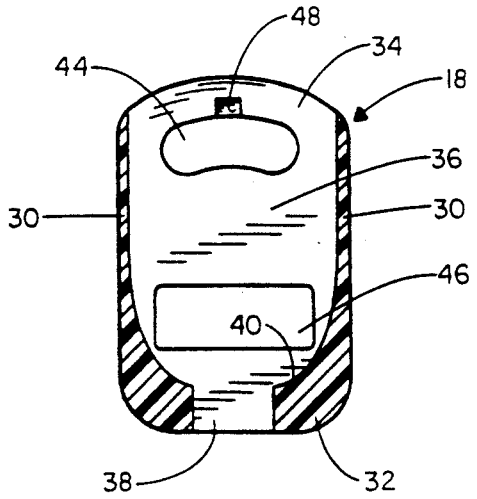
FIG. 4 is a vertical sectional view taken generally along the line 4—4 of FIG. 2 and shows the general outline of the cavity formed in the cover member.

The cover member 18 is of a molded plastic material construction and includes opposite side walls 26, 28 (FIG. 3) joined together by ends 30 (FIG. 4). Further, as is also best shown in FIG. 4, the cover member 18 has a relatively thick bottom 32 and an open top 34.

It will be seen that the walls of the cover member 18 define an internal cavity 36. The cavity 36 extends through the open top 34 and is provided with a continuation in the form of a central slot 38 through the bottom wall 32. The slot 38 is of a size to receive a blade of a key as will be described in more detail hereinafter.

Also, the top surface of the bottom wall 32 is configured as at 40 to generally match the configured of the lower edge of a key head as will also be described in detail hereinafter.

As is best shown in FIGS. 1, 3 and 4, the walls 26, 28 are provided with transversely aligned openings 42, 44 for receiving a key retainer, such as a key ring or chain (not shown). The side wall 28 is also provided with an opening 46 intended to be aligned with key identifying indicia on the head of a key.

Finally, the interior of each of the walls 26, 28 is provided immediately above a respective one of the openings 42, 44 with molded notches 48 which are of a tapered configuration as shown in FIG. 3 to form detents.

Figure 5:
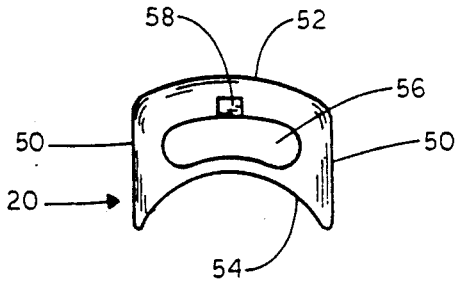
FIG. 5 is a front elevational view of an insert or plug for retaining a key head in the cavity of the cover member.
Figure 6:
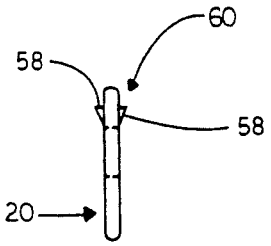
FIG. 6 is a side elevational view of the plug FIG. 5.

Referring now to FIGS. 5 and 6, it will be seen that the plug 20 is also of a generally rectangular outline including parallel sides 50. The plug 20 has an arcuate top wall 52 which matches the shape of the top wall 24 of the cover member 18 and a recessed arcuate bottom wall 54 which will match the contour of the upper edge of the intended key head.

The plug 20, as shown in FIG. 6, is of a constant thickness although it may be tapered in thickness to match the taper of the cavity 36.

The plug 20 is provided with an opening 56 therethrough which matches the outline and location of the openings 42, 44 so as to be aligned therewith when the plug 20 is in place within the cover member 18.

Finally, the plug 20 is provided on opposite faces thereof with projecting tabs 58 which increase in thickness upwardly so as to define retaining shoulders 60. When the plug 20 is inserted into the cavity 36, the tabs 58 align with the recesses 48 and when the plug 20 is fully inserted within the cavity 36, the shoulders 60 snap into the notches 48 and lock the plug in place.

Because the configuration of the plug matches that of the upper part of the cover member 18, once the plug 20 is locked in place, it cannot be readily removed.

It is to be understood that the configuration of the cavity 36 and the underside of the plug 20 will be varied depending upon the specific key head configuration. The typical key, generally identified by the numeral 12, is illustrated within the key cover 10 in FIG. 7. The key 12 will include a head 14 and a blade 16 in the customary manner. The head 14 will have a configuration under surface 68 and a configured top surface 70. The surface 40 at the bottom of the cavity 36 will correspond to the configuration of the surface 68 while the configuration of the surface 54 on the underside of the plug 28 will correspond to the top surface 70 of the head 14.

The key head 14 may also be provided with an identification panel 72. When the key 12 is mounted within the cover 10, the identification panel 72 will be aligned with the opening 46.

Referring now specifically to FIG. 7, it will be seen that in order to apply the cover 10 to the key 12, it is merely necessary to insert the key 12 into the cover member 18 through the open top with the blade 16 passing through the slot 38. The key 12 is pushed into the cover member 18 until the key head 14 seats on the surface 40 at the bottom of the cavity 36. Then the plug 20 is inserted into the cavity 36 through the open top 34 of the cover member 18 until the projecting tabs 58 snap into the notches 48. The shoulders 60 thus effectively prevent removal of the plug 20. The relationship of the size and the configuration of the key head 14 with respect to the cavity 36, the surface 40, and the under surface 54 of the plug 20 should be one wherein when the plug 20 is fully inserted into the cavity and locked in place, the key head 14 will be clamped between the plug 20 and the surface 40 as is clearly shown in FIG. 7.

It will be readily apparent that when the key cover 10 is specifically configured to receive a particular key configuration, all that is required to apply the key cover 10 to the key 12, for example, is to move the key 12 into the cover member 18 and then seat the plug 20 within the upper part of the cavity 36 and lock the plug 20 in place. No molding over the key and no gluing is in any way required. All that is necessary is to make certain that the face of the key head 14, bearing the identification panel 72, opposes the side wall 28 so as to be aligned with the opening 46.

It is to be understood that the cover member 18 may provide the faces of the side walls 26, 28 with any decorative design and may also include advertising indicia none of which has been specifically illustrated. Thus when an automobile dealer, for example, wishes to provide keys of automobiles being sold with specific covers, such as the cover 10, the covers may be rapidly installed key by key without the key being disassociated from the respective lock.

Figure 8:
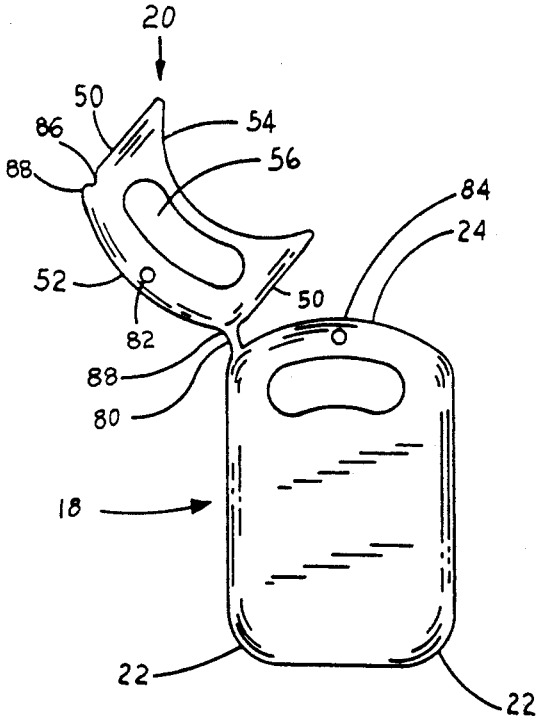
FIG. 8 is a side elevational view of a second embodiment of a cover member and plug formed in accordance with this invention.

A second embodiment of the key cover 10 is shown in FIG. 8. The second embodiment of the key cover 10 is substantially similar to the first embodiment except that in the second embodiment the cover member 18 and the plug insert 20 are pivotably connected to each other, but preferably formed as a single piece, connected by a hinge 80. Also, the projecting tabs 58 of the first embodiment are replaced by a nub or boss 82, extending from at least one side of the plug insert 20, in the second embodiment. Further, the notches 48 on the cover member 18 of the first embodiment are replaced by a preformed seat 84 in the second embodiment. Even further, the indentation 86 can be on either side 50 of plug 20.

The flexible hinge 80 can be a strap or any other flexible member and is sometimes referred to as a "living hinge." The flexible hinge may be of any width, but the width is preferably narrower than the open top 34. The hinge can be of any length, but the length is preferably short enough that the hinge will align and conform with the surface of the top wall 24 of the cover member 18 after the plug 20 is inserted into the cover member 18.

Figure 2:
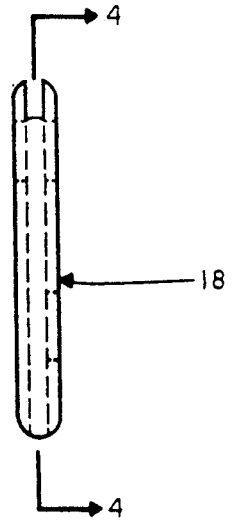
FIG. 2 is an end elevational view of the cover member of FIG. 1 taken from the right side thereof.

One end of the hinge 80 can be connected anywhere on the cover member 18, provided that the hinge 80 is of adequate length so the plug 20 can be inserted and latched into the cover member 18. It is preferable that the hinge 80 is connected to the cover member 18 at either end wall 30 and adjacent to the open top 34. The other end of the hinge 80 can be connected anywhere along the arcuate top wall 52 or the sides 50 of the plug 20. It is preferable that the hinge 80 is connected to the plug 20 at the junction of the arcuate top wall 52 and either of the sides 50, generally denoted as the area 88. It is also preferred that the hinge 80 is connected to the plug 20 such that the surface of the hinge 80 is flush with and conforms to the top wall 52 of the plug 20. The hinge 8 provides for the plug to rotate about an axis perpendicular to the hinge 80 and in an imaginary plane which is parallel to the side walls 26 and 28 and bisects the cover member 18 (along the line 4—4 as shown in FIG. 2).

In use, and as is disclosed by the second embodiment, a key is inserted into the open top 34 and its blade 16 passes through the central slot 38 of the cover member 18. The plug 20 is then inserted into the open top 34 by rotating the plug 20 about the axis perpendicular to the hinge 80. The plug 20 is latched in place by the boss or nub 82 which engages the seat 84 on the cover member 18. It should be noted, however, that alternate locking methods other than the nub and seat may be used and the invention is not limited to the boss or nub 82 on the plug 20 engaging the hole 84 on the cover member 18. For example, the nub or boss 82 can as easily be placed on the cover member 18 as on the plug 20, and the seat 84 can as easily be placed on the plug 20 as the cover member 18. Thus, the plug 20 can be latched in place by a boss or nub 82 on the cover member 18 engaging the seat 84 in the plug 20. Also, only a single nub and seat can be used instead of two as shown by the second embodiment. The seat 84 can be any type of indentation, groove or hole in which the nub can latch. Preferably, the seat 84 is a hole as shown in FIG. 8. Further the plug 20 has an indentation 86 which can be used as an alternate locking method by engaging a complementary nub (not shown in the drawing) mounted to the interior of either end wall 30. The above-mentioned locking methods can be used independently or in combination with each other.

Once the plug 20 is latched into the cover member 18, it is difficult to remove the plug 20 without destroying or deforming the cover member 18. Even though the preferred latching structure greatly inhibits the removal of the plug 20 after it has been inserted, the key cover 18 and hinge 80 are preferably molded of polypropylene which is extremely durable and would provide for repeated bending of the hinge without breaking. Thus, the key cover 10 could easily be made reusable by adopting a releasable latching structure.

Although only preferred embodiments of the key cover have been specifically illustrated and described herein, it is to be understood that minor variations may be made in the key cover without departing from the spirit and scope of the invention as defined by the appended claims.

The embodiments of the invention in which an exclusive property or privilege is claimed are defined as follows:

1. A key cover for a key of the type including an elongated blade and a wider head, said key cover comprising a body having a cavity therein for receiving a key head, said body also having an opening into the cavity through one end thereof, said opening being configured to receive a key head, and a slot at an opposite end thereof in communication with the cavity for receiving a key blade, means pivotally mounting a plug to the body adjacent to the opening, said plug being configured to fit snugly in the opening and be pivoted into the opening and means for securing the plug in the opening.

2. A key cover according to claim 1 wherein said pivotably mounting means is a hinge.

3. A key cover according to claim 2 wherein the hinge is a thin strap having one end connected to the plug and another end connected to the body.

4. A key cover according to claim 3 wherein the hinge is integrally formed with the plug and the body.

5. A key cover according to claim 3 wherein the plug, hinge and body are formed of a one piece plastic molding.

6. A key cover according to claim 1 wherein said cover member and said plug have aligned openings for receiving a key retainer.

7. A key cover according to claim 1 wherein said opposite end is of an axial extent and defines an end of said cavity of a configuration generally matching an outline of an intended key head adjacent its blade.

8. A key cover according to claim 7 wherein said plug has a lower edge profile generally matching an outline of an upper edge of a head of an intended key.

9. A key cover according to claim 1 wherein said cover member has walls separated by said cavity, and at least one of said walls has a key identification receiving opening therein.

10. A key cover according to claim 1 wherein said cover member and said plug have aligned matching upper edges.

11. A key cover according to claim 1 wherein said securing means includes a tab on one of said body and said plug, and a seat on the other of said body and said plug, said tab being receivable in the seat when the plug is received within the opening.

12. A key cover according to claim 11 wherein the tab is disposed on the plug and the seat is disposed on the body.

13. A key cover according to claim 12 wherein the tab is a boss projecting from the plug and the seat is formed by an aperture through a wall of the body.

14. A key cover for a key of the type including an elongated blade and a wider head, said key cover comprising:

a body having a cavity therein for receiving a key head;

said body having an opening into the cavity through one end thereof;

a slot at an opposite end of said cavity from said opening in communication with the cavity, said slot being configured to receive a key blade;

a plug having a first portion configured to fit snugly within said opening, and a second portion configured to remain facing outwardly of the opening; and a hinge connecting one of the first portion and the second portion to said body adjacent to the slot whereby said plug can be pivoted to fit the second portion snugly within said opening.

15. A key cover according to claim 14 wherein the opening has an end edge and the hinge extends from the end edge.

16. A key cover according to claim 14 wherein the body has an exterior surface contour adjacent to the opening, and the second surface contour of the body when the first portion is snugly fit within the opening.

17. A key cover according to claim 16 wherein the hinge has an exterior surface contour flush with the exterior surface contours of the body and the second portion, when the first portion is snugly fit within the opening.

18. A key cover according to claim 17, wherein the hinge is a living hinge formed of plastic.

* * * * *

UNITED STATES PATENT AND TRADEMARK OFFICE

CERTIFICATE OF CORRECTION

PATENT NO. : 5,181,605

DATED : January 26, 1993

INVENTOR(S) : THOMAS R. BISHOP et al.

It is certified that error appears in the above-identified patent and that said Letters Patent is hereby corrected as shown below:

Col. 6, claim 16, line 55:
before "surface" insert --portion has a contour configured to be flush with the exterior--

Signed and Sealed this

Fifteenth Day of March, 1994

Bruce Lehman

*Attest:*

BRUCE LEHMAN

*Attesting Officer*

*Commissioner of Patents and Trademarks*